US010168633B2

(12) United States Patent
Nakahara et al.

(10) Patent No.: US 10,168,633 B2
(45) Date of Patent: Jan. 1, 2019

(54) IMAGE FORMING APPARATUS HAVING IMAGE COLOR GAMUT ENLARGEMENT MODE

(71) Applicant: CANON KABUSHIKI KAISHA, Tokyo (JP)

(72) Inventors: Hisashi Nakahara, Numazu (JP); Akihiko Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/459,384

(22) Filed: Mar. 15, 2017

(65) Prior Publication Data

US 2017/0277056 A1 Sep. 28, 2017

(30) Foreign Application Priority Data

Mar. 22, 2016 (JP) ..... 2016-057719

(51) Int. Cl.
*G03G 15/01* (2006.01)

(52) U.S. Cl.
CPC ..... *G03G 15/0121* (2013.01)

(58) Field of Classification Search
CPC ..... G03G 15/0121
USPC ..... 399/54
See application file for complete search history.

(56) References Cited

U.S. PATENT DOCUMENTS

2003/0001918 A1* 1/2003 Tsuchiya ..... B41J 29/393 347/19
2006/0127133 A1 6/2006 Suzuki
2006/0188290 A1 8/2006 Sato et al.
2007/0098430 A1* 5/2007 Hoffman ..... G03G 15/0194 399/82

(Continued)

FOREIGN PATENT DOCUMENTS

EP 3 208 660 A1 8/2017
JP 08-227222 A 9/1996

(Continued)

OTHER PUBLICATIONS

Combined Search and Examination Report dated Sep. 14, 2017, in UK Application No. GB1704365.4.

(Continued)

*Primary Examiner* — Walter L Lindsay, Jr.
*Assistant Examiner* — Philip Marcus T Fadul
(74) *Attorney, Agent, or Firm* — Venable LLP

(57) ABSTRACT

An image forming apparatus includes a controller capable of executing a normal mode in which an electrostatic image formed on an image bearing member is developed by setting a peripheral velocity ratio of a developer bearing member relative to the image bearing member to a prescribed peripheral velocity ratio, and a color gamut enlargement mode in which a color gamut of an image to be formed on a recording medium is enlarged as compared to the normal mode by setting the peripheral velocity ratio of the developer bearing member relative to the image bearing member to a larger (Continued)

peripheral velocity ratio than the peripheral velocity ratio in the normal mode, wherein the controller identifies image color gamut information included in image data and forms an image by selecting the normal mode or the color gamut enlargement mode in accordance with the image color gamut information.

12 Claims, 8 Drawing Sheets

(56) References Cited

U.S. PATENT DOCUMENTS

| | | | | |
|---|---|---|---|---|
| 2009/0208232 | A1* | 8/2009 | Maezawa | G03G 15/0806 399/60 |
| 2014/0119756 | A1* | 5/2014 | Nakajima | G03G 15/5025 399/49 |
| 2015/0055965 | A1* | 2/2015 | Saito | G03G 15/5041 399/15 |

FOREIGN PATENT DOCUMENTS

| | | | |
|---|---|---|---|
| JP | 2013-033293 | A | 2/2013 |
| JP | 2013-210489 | A | 10/2013 |

OTHER PUBLICATIONS

U.S. Appl. No. 15/472,572, Tohru Saito, Akihiko Uchiyama, Hisashi Nakahara, Go Shindo, filed Mar. 29, 2017.

* cited by examiner

IMAGE FORMING APPARATUS HAVING IMAGE COLOR GAMUT ENLARGEMENT MODE

BACKGROUND OF THE INVENTION

Field of the Invention

The present invention relates to an image forming apparatus which forms an image on a recording medium using an electrophotographic technique.

Description of the Related Art

Conventionally, in image forming apparatuses such as laser beam printers, an in-line color system is known in which a plurality of image forming stations are arranged in parallel in a movement direction of an intermediate transfer belt. With an image forming apparatus adopting the in-line color system, first, an electrostatic latent image is formed on a surface of a photosensitive drum in the plurality of image forming stations. The electrostatic latent image formed on the photosensitive drum is developed by a developing apparatus as a toner image. In addition, toner images of respective colors formed in the plurality of image forming stations are primarily transferred onto the intermediate transfer belt so as to overlap with each other. The toner images of the respective colors primarily transferred onto the intermediate transfer belt are then secondarily transferred to a recording material such as a sheet of paper. Subsequently, as the recording material to which the toner images have been secondarily transferred is heated and pressurized by a fixing apparatus, the toner images are fixed to the recording material. In this manner, an image is formed on the recording material. In this case, density of the image to be formed on the recording material is desirably consistent with density desired by a user. In addition, a tinge of the image to be formed on the recording material is also desirably consistent with a tinge desired by the user.

In consideration thereof, in a technique disclosed in Japanese Patent Application Laid-open No. H8-227222, a tinge of an image to be formed on a recording material is adjusted by increasing an amount of toner conveyed from a developing sleeve of a developing roller to a photosensitive belt (a belt-shaped photoreceptor). Specifically, in the technique disclosed in Japanese Patent Application Laid-open No. H8-227222, the developing roller includes the developing sleeve and a magnet roller configured to be rotatable inside the developing sleeve. By increasing a rotational speed of the magnet roller, a toner amount conveyed from the developing sleeve to the photosensitive belt is increased.

Furthermore, conventionally, a technique is known for increasing a tinge selection range (a color gamut) or increasing density of an image to be formed on a recording material by varying a peripheral velocity difference between a photosensitive drum and a developing roller. In a technique disclosed in Japanese Patent Application Laid-open No. 2013-210489, a color gamut of an image is enlarged and an upper limit value of density of the image is increased by varying a peripheral velocity difference between a photosensitive drum and a developing roller. In addition, the technique disclosed in Japanese Patent Application Laid-open No. 2013-210489 suppresses toner scattering, image thinning, and the like which are caused when the peripheral velocity difference between the photosensitive drum and the developing roller is increased. Specifically, instead of increasing the peripheral velocity difference between the photosensitive drum and the developing roller by increasing a peripheral velocity of the developing roller, the peripheral velocity difference between the photosensitive drum and the developing roller is increased by reducing a peripheral velocity of the photosensitive drum. Accordingly, toner scattering, image thinning, and the like are suppressed.

However, in recent years, there are demands to approximate an image formed by an image forming apparatus to an image displayed on a display. In other words, there are demands to enlarge a color gamut of an image to be formed on a recording material. In order to do so, a peripheral velocity ratio between a photosensitive drum and a developing roller must be increased. This can be realized by providing a printing operation for enlarging a color gamut separately from a normal printing operation. In this case, in the printing operation for enlarging a color gamut, the peripheral velocity ratio between the photosensitive drum and the developing roller is set larger than in the normal printing operation.

However, when the peripheral velocity ratio between the photosensitive drum and the developing roller is increased, toners slide against each other and become vulnerable to degradation. When the printing operation for enlarging the color gamut is performed over a long period of time, the degradation of the toners may result in creating a defect in an image. When toner is consumed rapidly, since there is less degradation of the toner when the toner is used up, an image can be formed on a recording material in a preferable manner. However, when the toner is consumed slowly, since the toner degrades before the toner is used up, a defect may occur in an image formed on a recording material. In this case, the degradation of the toner can conceivably be reduced by having the user himself/herself switch between the normal printing operation and the printing operation for enlarging the color gamut. However, since such settings must be performed by the user himself/herself, usability declines.

SUMMARY OF THE INVENTION

An object of the present invention is to forma preferable image while maintaining usability.

In order to achieve the object described above, an image forming apparatus embodying the present invention is an image forming apparatus, for forming an image on a recording medium based on image data, comprising:

an image bearing member on which an electrostatic image is formed;

a developer bearing member configured to bear a developer for developing the electrostatic image formed on the image bearing member; and a controller configured to be capable of executing a normal mode in which the electrostatic image formed on the image bearing member is developed by setting a peripheral velocity ratio of the developer bearing member to the image bearing member to a prescribed peripheral velocity ratio, and a color gamut enlargement mode in which a color gamut of an image to be formed on the recording medium is enlarged as compared to the normal mode by setting the peripheral velocity ratio of the developer bearing member to the image bearing member to a larger peripheral velocity ratio than the peripheral velocity ratio in the normal mode, wherein the controller is configured to identify image color gamut information included in the image data, and form an image by selecting the normal mode or the color gamut enlargement mode in accordance with the image color gamut information.

The present invention enables a preferable image to be formed while maintaining usability.

Further features of the present invention will become apparent from the following description of exemplary embodiments with reference to the attached drawings.

DESCRIPTION OF THE EMBODIMENTS

Figure 1:
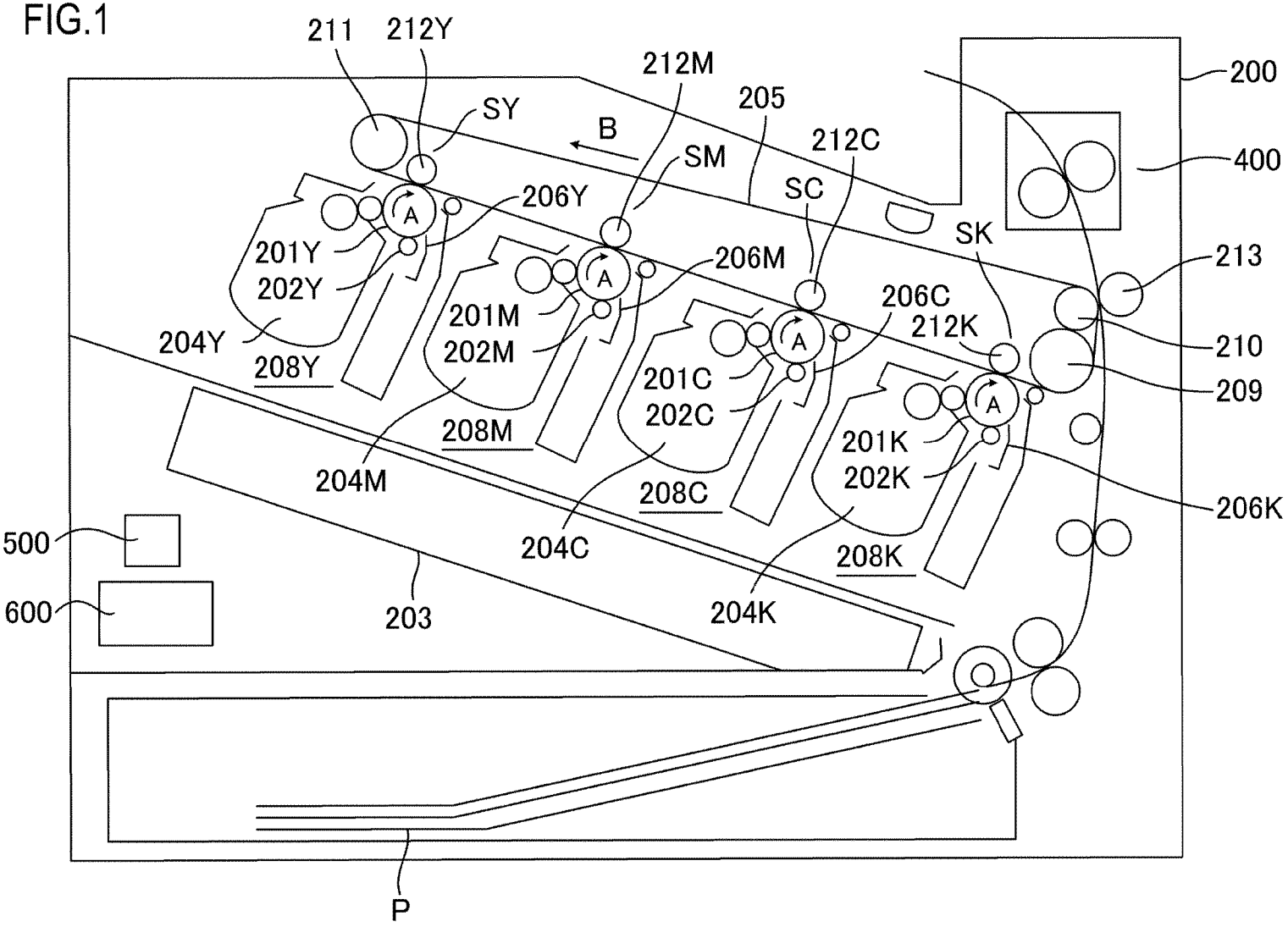
FIG. 1 is a schematic sectional view of an image forming apparatus according to a first embodiment.

Modes for carrying out the present invention are illustratively explained in detail below on the basis of the following embodiments with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

(First embodiment)

<Overall Configuration of Image Forming Apparatus 200>

The present embodiment adopts a configuration which enables execution of a normal image formation mode in which an image is formed with normal density and a wide-color gamut image formation mode in which a color gamut of an image is enlarged by changing a peripheral velocity ratio between a photosensitive drum 201 as an image bearing member and a developing roller 302 as a developer bearing member. The respective image formation modes differ in the peripheral velocity ratio between the photosensitive drum 201 and the developing roller 302. In this case, the peripheral velocity ratio between the photosensitive drum 201 and the developing roller 302 is expressed as peripheral velocity ratio =peripheral velocity of developing roller 302 /peripheral velocity of photosensitive drum 201×100(%). Moreover, it is assumed that a positive direction of the peripheral velocity ratio between the photosensitive drum 201 and the developing roller 302 is a direction in a portion where the photosensitive drum 201 and the developing roller 302 come into contact with each other. For example, when the photosensitive drum 201 and the developing roller 302 respectively rotate in a same direction in the contact portion at a peripheral velocity of 50 mm/sec, the peripheral velocity ratio is 100%. On the other hand, a case where the photosensitive drum 201 and the developing roller 302 rotate in opposite directions in the contact portion is also conceivable. In this case, when the peripheral velocity of the photosensitive drum 201 is 50 mm/sec and the peripheral velocity of the developing roller 302 is −50 mm/sec, the peripheral velocity ratio between the photosensitive drum 201 and the developing roller 302 is −100%.

In the normal image formation mode as a normal mode, toner adhered to the developing roller 302 is conveyed to the photosensitive drum 201 by an action of a development contrast between a potential of an electrostatic latent image as an electrostatic image formed on the photosensitive drum 201 and a potential of the developing roller 302. Accordingly, the electrostatic latent image formed on the photosensitive drum 201 is developed as a toner image as a developer image. On the other hand, in the wide-color gamut image formation mode as a color gamut enlargement mode, by increasing the peripheral velocity ratio between the photosensitive drum 201 and the developing roller 302, a toner supply amount per unit area from the developing roller 302 to the photosensitive drum 201 is increased. Accordingly, due to the action of the development contrast between the potential of the electrostatic latent image formed on the photosensitive drum 201 and the potential of the developing roller, a maximum amount of toner adherable to the developing roller 302 is conveyed to the photosensitive drum 201.

Hereinafter, a process cartridge 208 and the image forming apparatus 200 according to the present embodiment will be described. FIG. 1 is a schematic sectional view of the image forming apparatus 200 according to the first embodiment. The image forming apparatus 200 according to the present embodiment is an in-line system full-color laser printer adopting an intermediate transfer system. The image forming apparatus 200 is capable of forming a full-color image on a recording material P (for example, recording paper) as a recording medium in accordance with image information. The image information is input to a CPU 20 provided in the image forming apparatus 200 from an image reading apparatus (not shown) connected to the image forming apparatus 200 or from a host device (not shown) such as a personal computer connected to the image forming apparatus 200 so as to be capable of communication.

In addition, as a plurality of image forming portions, the image forming apparatus 200 includes first to fourth image forming portions S (SY, SM, SC, and SK) for forming images of the respective colors of yellow (Y), magenta (M), cyan (C), and black (K). In this case, the image forming portion S includes the process cartridge 208 and primary transfer rollers 212 (212Y to 212K) arranged so as to oppose the photosensitive drum 201 as an image bearing member via an intermediate transfer belt 205. In the present embodiment, the first to fourth image forming portions SY to SK are arranged in a single row in a direction (diagonal) intersecting both vertical and horizontal directions. Moreover, in the present embodiment, configurations and operations of the first to fourth image forming portions SY to SK are substantially the same with the exception of differences in colors of images to be formed. Therefore, unless the image forming portions must be distinguished from one another, the suffixes Y, M, C, and K will be omitted and the image forming portions will be collectively described. However, the present invention is not limited to this configuration and, alternatively, a configuration may be adopted in which the image forming portion for black (K) has a large shape.

As a plurality of image bearing members, the image forming apparatus 200 includes four photosensitive drums 201 as image bearing members which are drum-shaped electrophotographic photoreceptors arranged parallel to each other in a direction intersecting both vertical and horizontal directions. The photosensitive drum 201 is rotationally driven in a direction of an arrow A (clockwise) in FIG. 1 by a driving force of a motor (refer to FIG. 2). In addition, a charging roller 202 as charging means configured to uniformly charge a surface of the photosensitive drum 201 and a scanner unit 203 configured to form an electrostatic latent image on the photosensitive drum 201 by irradiating a laser based on image information are arranged in a periphery of the photosensitive drum 201.

In addition, a developing unit 204 configured to develop an electrostatic latent image as an electrostatic image as a toner image and a cleaning blade 206 configured to remove toner remaining on the surface of the photosensitive drum 201 after the toner image is transferred are arranged in the periphery of the photosensitive drum 201 as an image bearing member. Furthermore, a preliminary exposure LED 216 configured to eliminate a potential on the photosensitive drum 201 is arranged in the periphery of the photosensitive drum 201. In addition, the intermediate transfer belt 205 for transferring a toner image on the photosensitive drum 201 to the recording material P as a recording medium is arranged so as to oppose the four photosensitive drums 201.

The photosensitive drum 201 as an image bearing member, the charging roller 202, the developing unit 204, and the cleaning blade 206 are integrally configured as the process cartridge 208. The process cartridge 208 is configured to be attachable to and detachable from an apparatus main body of the image forming apparatus 200. In addition, in the present embodiment, all of the process cartridges 208 for the respective colors have a same shape, and toners of the respective colors of yellow (Y), magenta (M), cyan (C), and black (K) are housed in the process cartridges 208. Furthermore, as the toners in the present embodiment, toners having negative-charging characteristics are used.

While the present embodiment is described using a process cartridge in which a photosensitive drum and a developing unit are integrally configured, this configuration is not restrictive. A configuration may be adopted in which a photosensitive unit including a photosensitive drum and a developing unit including a developer bearing member are respectively separately attachable to and detachable from an apparatus main body of an image forming apparatus. In addition, while the toners are one-component developers, two-component developers or magnetic toners may be used depending on the configuration.

The intermediate transfer belt 205 formed by an endless belt is in contact with all of the photosensitive drums 201 and moves in a direction of an arrow B (counterclockwise) in FIG. 1. In addition, the intermediate transfer belt 205 is stretched over a driver roller 209, a secondary transfer opposing roller 210, and a driven roller 211. Four primary transfer rollers 212 are arranged parallel to each other on a side of an inner peripheral surface of the intermediate transfer belt 205 so as to oppose each photosensitive drum 201. Furthermore, a bias having an opposite polarity (in the present embodiment, a positive polarity) to the normal charging polarity of the toners is applied to the primary transfer rollers 212 from a primary transfer bias power supply (not shown). Accordingly, a toner image as a developer image on the photosensitive drum 201 as the image bearing member is transferred onto the intermediate transfer belt 205.

In addition, a secondary transfer roller 213 is arranged at a position opposing the secondary transfer opposing roller 210 on a side of an outer peripheral surface of the intermediate transfer belt 205. Furthermore, a bias having an opposite polarity to the normal charging polarity of the toners is applied to the secondary transfer roller 213 from a secondary transfer bias power supply (not shown). Accordingly, a toner image on the intermediate transfer belt 205 is transferred onto the recording material P. In the present embodiment, the image forming apparatus 200 is provided with a storage portion 500 and a controller 600. The storage portion 500 is, for example, a storage medium such as a hard disk drive (HDD) or a flash memory and stores information related to the image forming apparatus 200. Furthermore, the controller 600 is, for example, a processing unit such as a CPU and controls operations of devices inside the image forming apparatus 200 by executing a program stored in the storage portion 500. In the present embodiment, switching between the normal image formation mode and the wide-color gamut image formation mode is performed as the controller 600 executes a program stored in the storage portion 500.

<Configuration of Process Cartridge 208>

Figure 2:
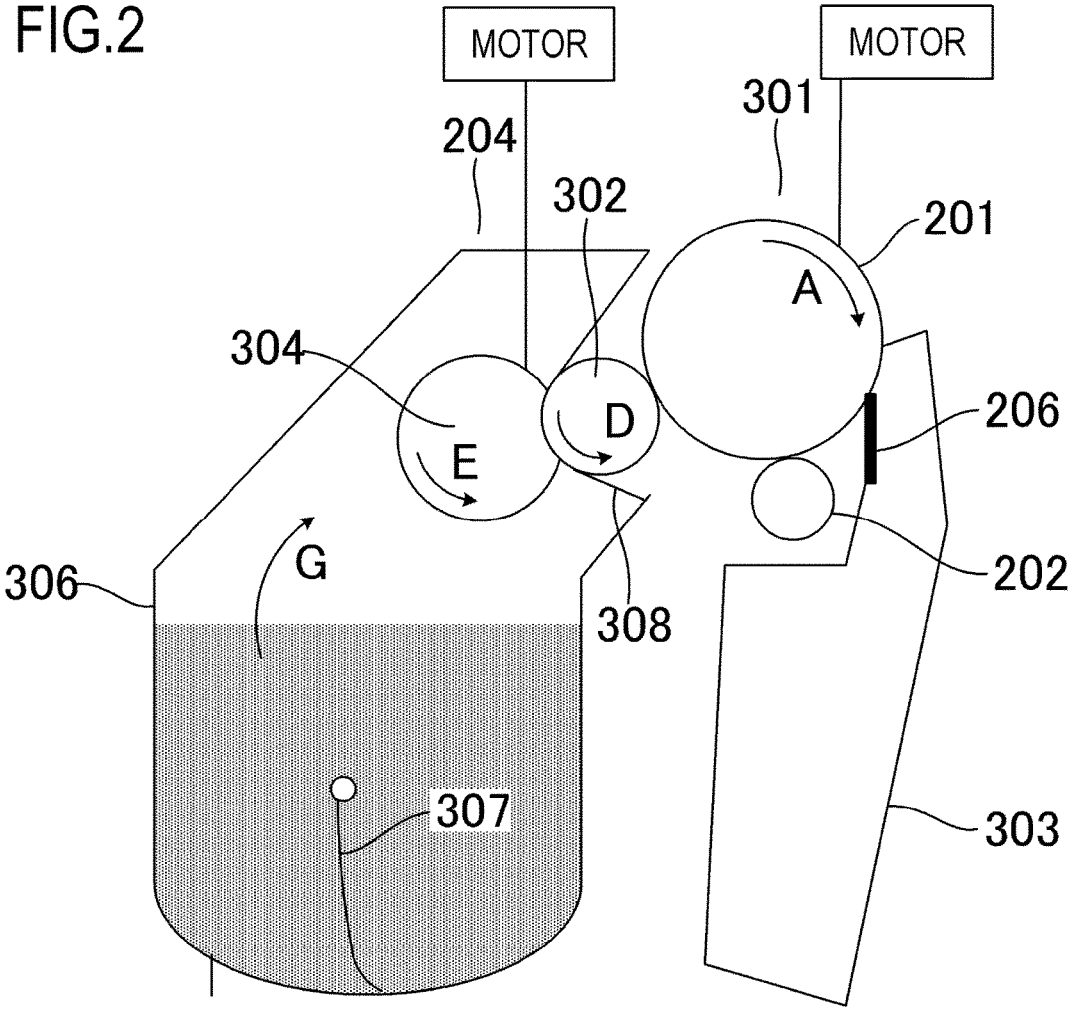
FIG. 2 is a schematic sectional view of a process cartridge according to the first embodiment.

Next, an overall configuration of the process cartridge 208 to be attached to and detached from the image forming apparatus 200 according to the present embodiment will be described with reference to FIG. 2. FIG. 2 is a schematic sectional view of the process cartridge 208 according to the first embodiment. Specifically, FIG. 2 is a schematic sectional view of the process cartridge 208 as viewed from an axial direction of a center of rotation of the photosensitive drum 201. Moreover, in the present embodiment, configurations and operations of the process cartridges 208 of the respective colors are the same with the exception of types (colors) of toners housed therein.

The process cartridge 208 includes a photoreceptor unit 301 including the photosensitive drum 201 as an image bearing member and the like and the developing unit 204 including the developing roller 302 as a developer bearing member and the like. The photoreceptor unit 301 includes a cleaning frame body 303 which supports various elements inside the photoreceptor unit 301. The photosensitive drum 201 is rotatably attached to the cleaning frame body 303 via a bearing member (not shown). In addition, the photosensitive drum 201 is rotationally driven in the direction of the arrow A (clockwise) in FIG. 2 in accordance with an image forming operation as a driving force of a motor (refer to FIG. 2) as a drive source is transmitted to the photoreceptor unit 301.

As the photosensitive drum 201 as an image bearing member to perform a central role of image forming processes, an organic photoreceptor is used in which an outer circumferential surface of an aluminum cylinder is coated with an undercoat layer, a carrier generation layer, and a carrier transfer layer, which are functional membranes, in this order. In addition, the cleaning blade 206 and the charging roller 202 are arranged in the photoreceptor unit 301 so as to come into contact with a circumferential surface of the photosensitive drum 201. Furthermore, untransferred toner removed from the surface of the photosensitive drum 201 by the cleaning blade 206 is housed in the cleaning frame body 303.

The charging roller 202 which is charging means is driven so as to follow the photosensitive drum 201 when a roller portion made of conductive rubber is brought into pressure contact with the photosensitive drum 201. Prescribed DC voltage is applied to a core of the charging roller 202 and, accordingly, a uniform dark-part potential (Vd) is formed on the surface of the photosensitive drum 201. In addition, as described earlier, the scanner unit 203 exposes the photosensitive drum 201 with laser light L which is emitted in correspondence with image data.

Subsequently, as charges on the surface of the photosensitive drum 201 as an image bearing member are eliminated by a carrier from the carrier generation layer, the potential of the surface of the exposed photosensitive drum 201 drops. As a result, on the surface of the photosensitive drum 201, a portion which is exposed by the laser assumes a prescribed light-part potential (Vl) and an unexposed portion which is not exposed by the laser assumes a prescribed dark-part potential (Vd). Accordingly, an electrostatic latent image is formed on the photosensitive drum 201.

The developing unit 204 includes the developing roller 302 as a developer bearing member (which rotates in a direction of an arrow D), a developing blade 308, and a toner supplying roller 304 (which rotates in a direction of an arrow E). In addition, the developing unit 204 includes a toner housing chamber 306 which houses the toner. The toner is stirred inside the toner housing chamber 306 by an action (rotation in a direction of an arrow G) of a stirring member 307. In addition, in the present embodiment, a prescribed DC bias is applied to the developing roller 302 as a developer bearing member. Toner adheres to a light-part potential portion of the photosensitive drum 201 due to a potential difference between the photosensitive drum 201 and the developing roller 302 in a developing portion where the photosensitive drum 201 and the developing roller 302 come into contact with each other. Accordingly, an electrostatic latent image on the photosensitive drum 201 is visualized.

<Configuration of Fixing Apparatus>

Figure 3:
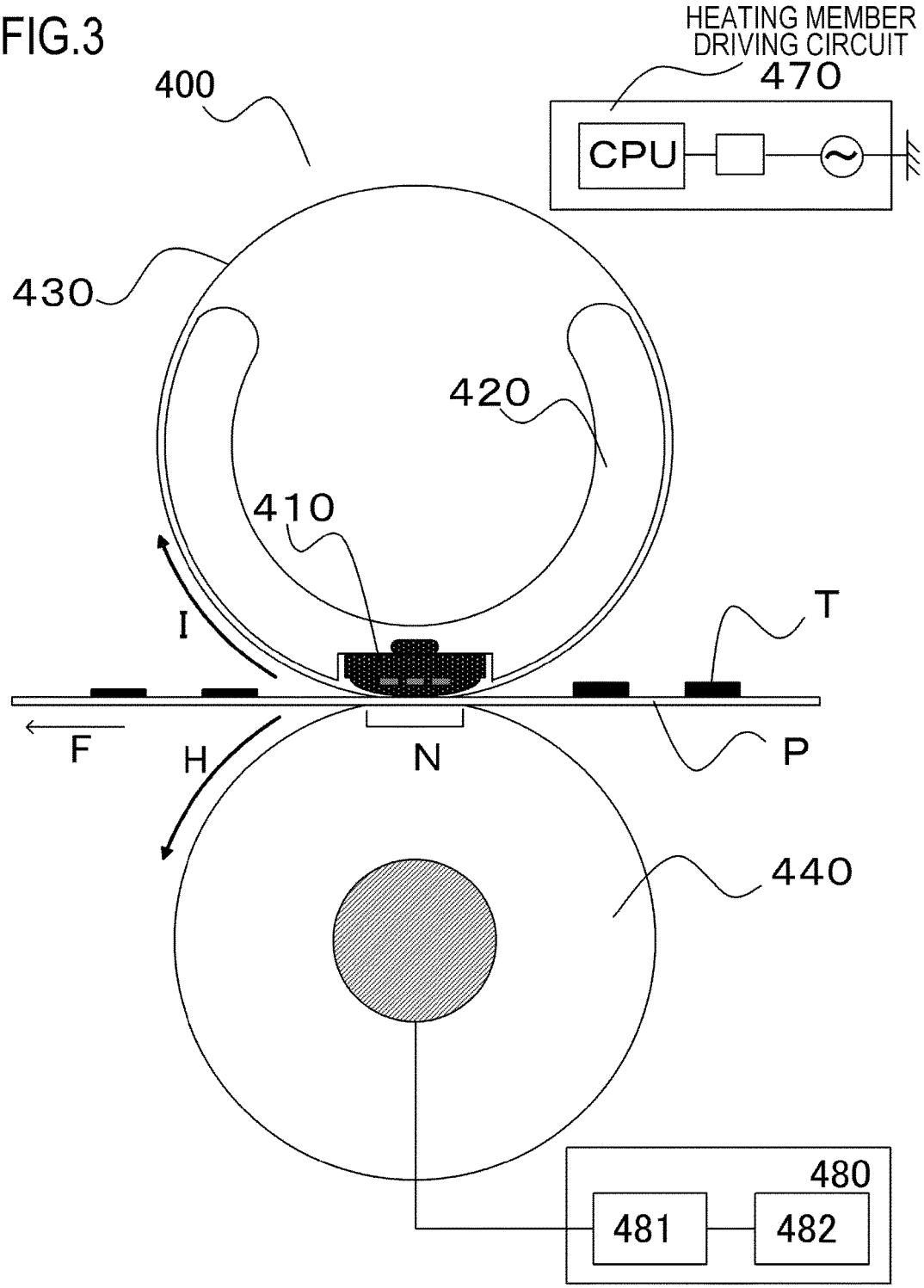
FIG. 3 is a schematic sectional view of a fixing apparatus according to the first embodiment.

FIG. 3 is a schematic sectional view of a fixing apparatus 400 according to the first embodiment. The fixing apparatus 400 according to the present embodiment is a fixing apparatus adopting a pressure roller drive system and includes a heating member 410, a cylindrical film 430 which comes into sliding contact with the heating member 410, and a pressure roller 440 which forms a fixing nip portion N with the heating member 410 via the film 430. In addition, the recording material P as a recording medium is sandwiched and conveyed in the fixing nip portion N and, at the same time, heated by heat from the heating member 410. Accordingly, an unfixed image formed on the recording material P is fixed by heating to the recording material P.

In a state of being held by a heating member supporter 420, the heating member 410 is in pressure contact with a prescribed pressing force with the pressure roller 440 which is a pressing member via the cylindrical film 430 as a flexible member. In addition, the pressure roller 440 is rotationally driven in a direction of an arrow H in FIG. 3 by a rotational driving portion 480. As the pressure roller 440 rotates and slidingly moves against an outer circumferential surface of the film 430, the film 430 rotates in a direction of an arrow I in FIG. 3. Specifically, the film 430 rotates in the direction of the arrow I around the heating member supporter 420 holding the heating member 410.

In addition, the heating member 410 is electrically heated by a heating member driving circuit 470 as power is supplied to the heating member 410 from a commercial power supply. Furthermore, the heating member 410 is controlled to a prescribed temperature adjusted for printing. In this state, the recording material P bearing an unfixed toner image T is sandwiched and conveyed in a direction of an arrow F in the fixing nip portion N. Furthermore, as heat from the heating member 410 is applied to the recording material P via the film 430, the unfixed toner image T is fixed to the recording material P as a recording medium. Subsequently, the recording material P having passed the fixing nip portion N is separated in a curving manner from a surface of the film 430 and then discharged. Moreover, in the fixing apparatus 400 according to the present embodiment, a reference of paper passage of the recording material P is set to a central section in a longitudinal direction (a direction perpendicular to the direction of the arrow F of the recording material P) of each member.

As the cylindrical film 430, for example, a thin film cylinder with a thickness of around 30μ to 100 μm and which uses a polyimide or SUS base layer is used. In addition, releasability from the toner is maintained by coating the base layer with PFA or PTFA via a primer layer. Furthermore, a slide grease (not shown) is applied between an inner circumferential surface of the film 430 and the heating member supporter 420 and, accordingly, slidability between the film 430 and the heating member supporter 420 is maintained.

The pressure roller 440 is a rotating body in which, for example, an elastic layer such as silicone rubber is formed on a core. In the present embodiment, a releasing layer with a thickness of around 10μ to 100 μm and which is made of FEP, PFA, or the like is provided on the base layer via a primer layer. Accordingly, releasability from the toner is maintained. In addition, the heating member supporter 420 is formed of a highly heat-resistant resin such as PPS, PAI, PI, PEEK, and liquid crystal polymer having a heat insulating property, high heat resistance, and rigidity or a composite material of the resin and ceramics, metal, glass, or the like. In this case, PPS stands for polyphenylene sulfide, PAI stands for polyamide-imide, PI stands for polyimide, and PEEK stands for polyether ether ketone. Furthermore, the rotational driving portion 480 includes a motor 481 which rotationally drives the pressure roller 440, a controller (CPU) 482 which controls rotation of the motor 481, and the like. As the motor 481, for example, a DC motor or a stepping motor can be used.

<Description of Image Data Processing and Operations>

Figure 4:
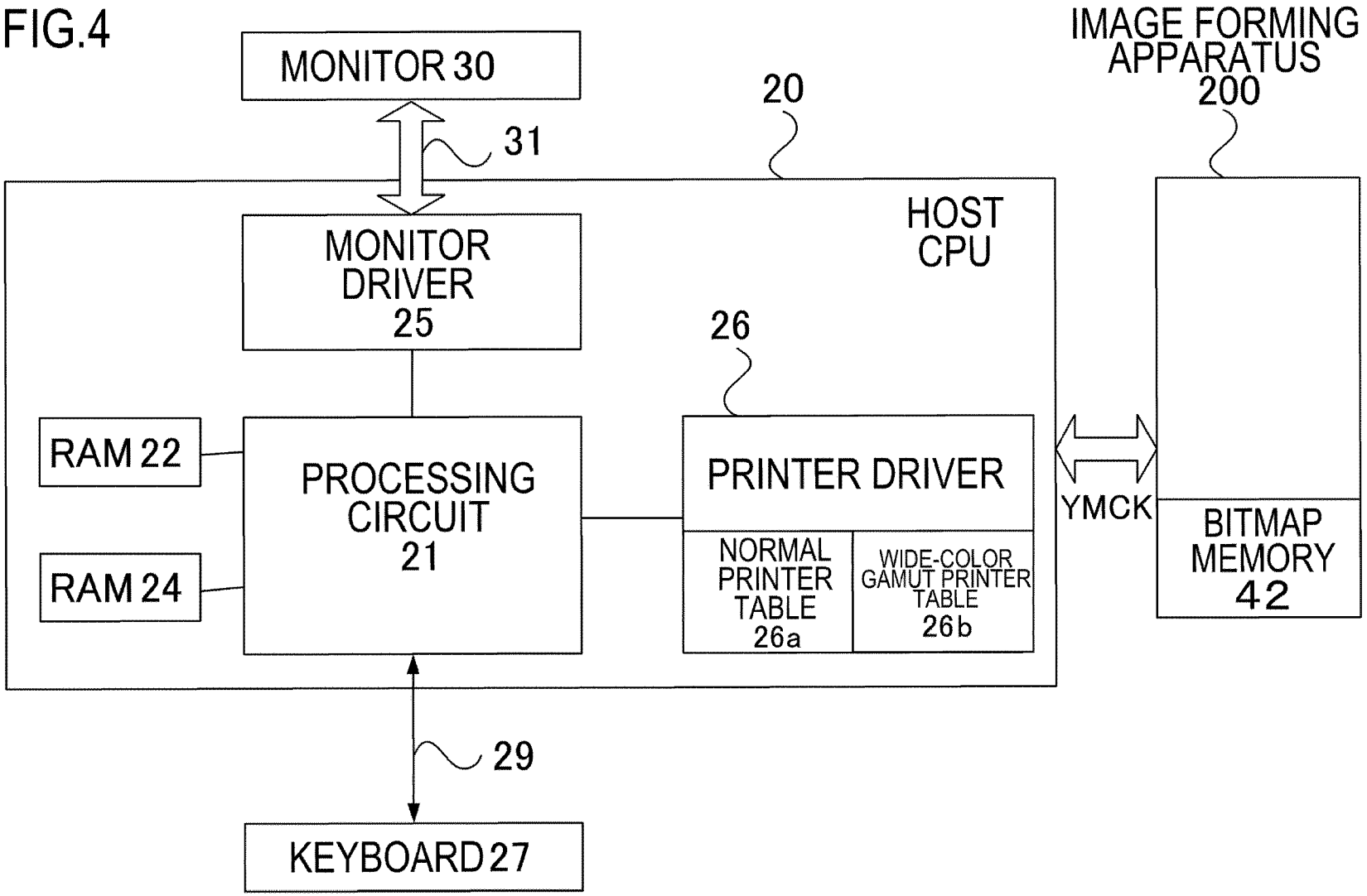
FIG. 4 is a block diagram showing a configuration of an image forming system according to the first embodiment.

FIG. 4 is a block diagram showing a configuration of an image forming system according to the first embodiment. As shown in FIG. 4, the image forming system includes a host CPU 20, a color monitor 30, the image forming apparatus 200, and a keyboard 27. The host CPU 20 includes a processing circuit 21, a RAM (random access memory) 22 which serves as a work area of the processing circuit 21, a ROM (read only memory) 24 which serves as a static storage area of the processing circuit 21, a monitor driver 25, and a printer driver 26.

An operator accesses the host CPU 20 via the keyboard 27. The keyboard 27 is connected to the processing circuit 21 by an interface 29. Using the keyboard 27, the operator causes a program instruction stored in the processing circuit 21 to be executed, a color image to be displayed on the monitor 30, and a corresponding color image to be printed by the image forming apparatus 200. The host CPU 20 is also connected to other peripheral devices such as a disk drive, a tape drive, a color video interface, and a color scanner interface. However, in the present embodiment, descriptions of such peripheral devices will be omitted. Moreover, the peripheral devices interact with a storage program instruction to be executed by the processing circuit 21 to, for example, scan a color image and store the color image in the RAM 22, cause the monitor 30 to display an image, or process colors of an image. In addition, the peripheral devices cause the image forming apparatus 200 to print a processed image.

Furthermore, in accordance with a stored program instruction, the processing circuit 21 forms a color image on the monitor 30. The processing circuit 21 provides the monitor driver 25 with a color image and the monitor driver 25 generates RGB values for each pixel of the monitor 30. In this case, in RGB values, "R" stands for red, "G" stands for green, and "B" stands for blue. RGB values are provided via an interface 31 to the monitor 30 and the values are displayed on the monitor 30. In addition, in response to a request, the processing circuit 21 provides the printer driver 26 with information on a color image in order to execute an image forming operation by the image forming apparatus 200. Based on color values from the processing circuit 21, the printer driver 26 generates CMY values for each pixel of the color image. CMY values are determined in accordance with a normal printer table 26*a* or a wide-color gamut printer table 26*b*. In this case, the normal printer table 26*a* is a table which provides CMY values for all colors printable by the image forming apparatus 200. In addition, the wide-color gamut printer table 26*b* is a table which provides CMY values for all colors not printable using the normal printer table 26*a*. As will be described later, in the present embodiment, a range of the normal printer table 26*a* is a range of a maximum value of CMY values corresponding to a maximum value of values printable by the image forming apparatus 200 (values in a Lab color space). For example, with respect to red, in the normal image formation mode, images can be reproduced in a range expressed as (R, G, B)=(180%, 0%, 0%)⇒ (L*, a*, b*)=(38, 62, 54)⇒(C, M, Y, K)=(0%, 100%, 100%, 0%). On the other hand, with respect to red, in the wide-color gamut image formation mode, images can be reproduced in a range expressed as (R, G, B)=(200%, 0%, 0%)⇒(L*, a*, b*)=(43, 67, 58)⇒(C, M, Y, K)=(0%, 100%, 100%, 0%). In other words, in the wide-color gamut image formation mode, a color of R=200% in which an image cannot be formed in the normal image formation mode can be expressed. Note that values of (C, M, Y, K) are maximum (MAX) values in both the normal image formation mode and the wide-color gamut image formation mode. Accordingly, in the case of the normal printer table 26*a*, a "color not printable" is a color of which CMY values exceed 100%.

Figure 5:
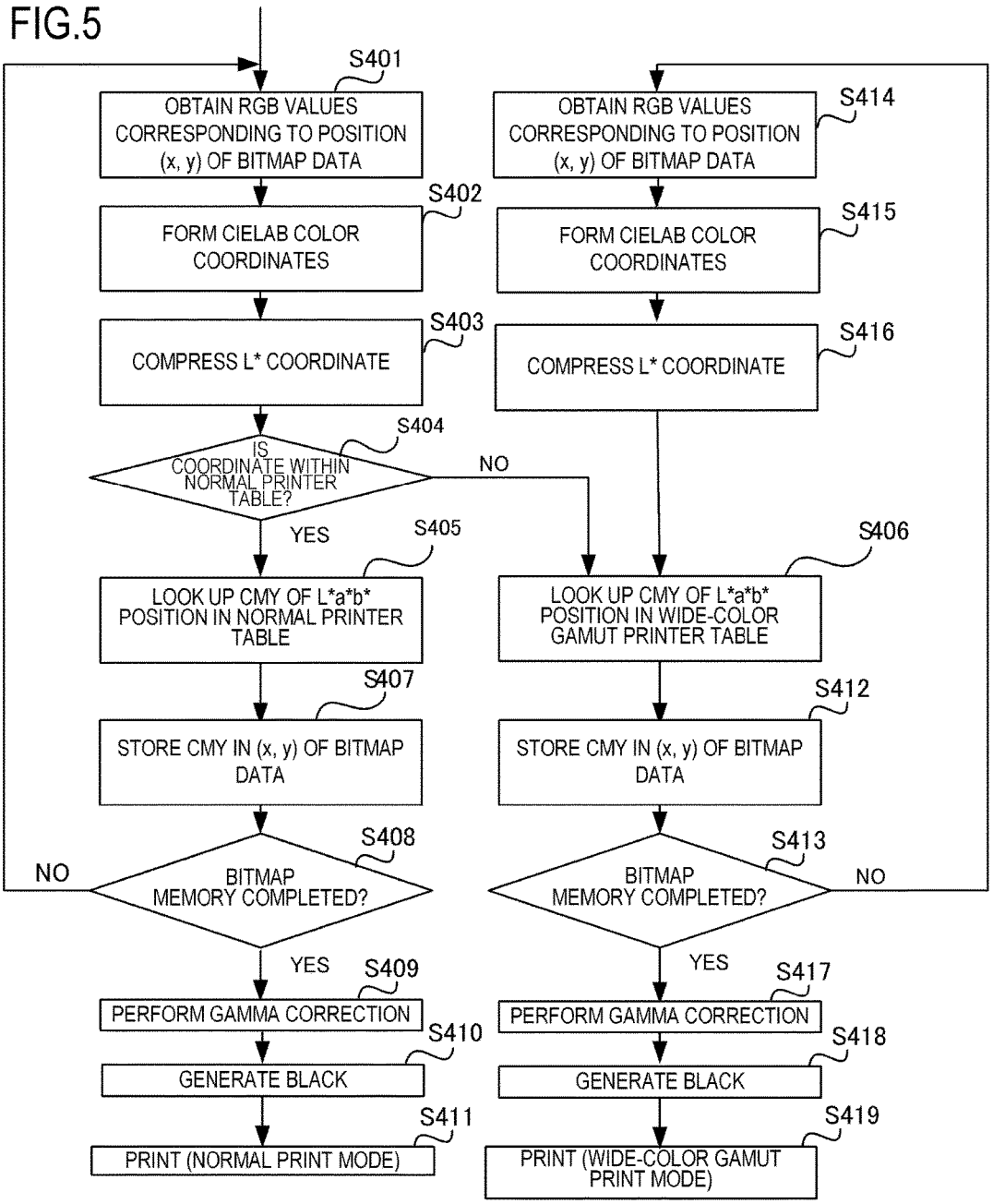
FIG. 5 is a flow chart showing a flow of an image forming operation according to the first embodiment.

FIG. 5 is a flow chart showing a flow of an image forming operation according to the first embodiment. Specifically, FIG. 5 is a flow chart for explaining an operation in which the printer driver 26 selects CMY values from color data provided to the processing circuit 21. First, in step S401, with respect to dots constituting a digital image, the printer driver 26 obtains RGB values for coordinates (x, y) of each dot. In this case, a dot refers to a single element constituting a digital image. With digital images, a plurality of small dots aggregate to create a single image. In step S402, from the RGB values, the printer driver 26 forms a color coordinate value not dependent on the image forming apparatus 200 (hereinafter, referred to as a device-independent color coordinate value). The device-independent color coordinates are favorably CIELAB color coordinates. This is because, since a CIELAB color space is perceptually uniform, sections with an equal size in the CIELAB color space each match a size equal to a perceived color. In addition, in the CIELAB color space, hue and brightness can be confirmed using cylindrical coordinates. In other words, intuitive color coordinates of the CIELAB color space enable a color gamut map to be readily defined.

In step S403, brightness coordinates are compressed with respect to portions (a plurality of portions) representing extreme brightness on an L* axis of the CIELAB color space. Moreover, step S403 may be directly executed by mathematically operating an L* value derived in step S402. Alternatively, step S403 may be indirectly executed by storing CMY values transformed from an L* value in the normal printer table 26*a* or the wide-color gamut printer table 26*b*.

When indirectly performing step S403, compressed values are to be stored in advance in the normal printer table 26*a* or the wide-color gamut printer table 26*b*. In other words, the normal printer table 26*a* or the wide-color gamut printer table 26*b* is adjusted such that, for example, a value with a brightness L*=99 actually corresponds to a brightness L*=94. In a similar manner, a value with a brightness L*=7 actually corresponds to a brightness L*=26. A central portion of the brightness range, such as values where L*=38 to 90, remains uncorrected. Accordingly, brightness can be compressed without having to perform direct compression through data operation. In this case, step S403 is optional. However, step S403 enables even a color with extreme brightness to be printed so that a change in brightness can be perceived. For this reason, step S403 is favorably executed.

Since the monitor 30 displays color using light emitters, the monitor 30 is configured to be capable of displaying colors with higher brightness values than the image forming apparatus 200. In contrast, a maximum value of brightness of an image to be formed by the image forming apparatus 200 is limited by whiteness of a sheet of paper on which a color image is formed. In addition, since the monitor 30 is capable of completely erasing light from the light emitters, the monitor 30 can display colors with lower brightness values than an image printed by the image forming apparatus 200. This is because even black toner partially reflects peripheral light. Therefore, in order to reliably print a given color, even when printing with a maximum value and a minimum value of brightness, the brightness value determined in step S402 is desirably compressed in step S403 into a range which is printable by the image forming apparatus 200.

Figure 8:
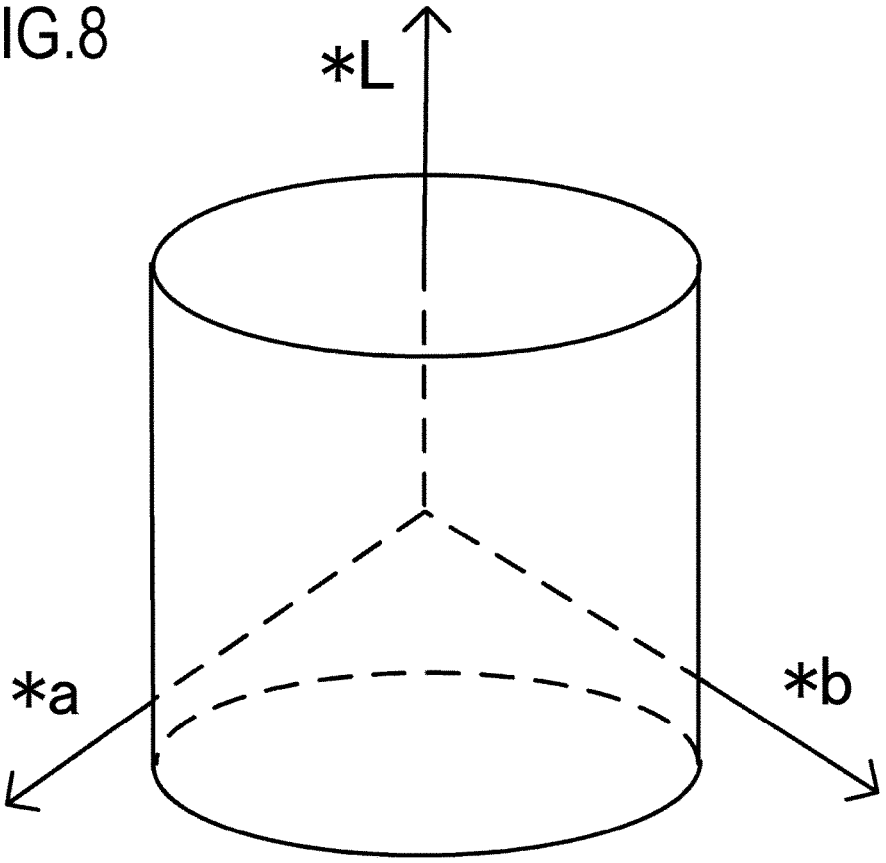
FIG. 8 is a schematic diagram illustrating a printer table according to the first embodiment.

Next, in step S404, a determination is made on whether or not L*·a*·b* coordinates (which correspond to coordinates in a L*a*b* color system) as image color gamut information generated in steps S402 and S403 are within a range of the normal printer table 26*a* (which corresponds to within a first color gamut). In the present embodiment, the range of the normal printer table 26*a* corresponds to a "range of the first color gamut". In addition, a range of the wide-color gamut printer table 26*b* corresponds to a "range of a second color gamut". When the L*·a*·b* coordinates (which correspond to coordinates in the L*a*b* color system) are within the range of the normal printer table 26*a*, a transition is made to step S405. Subsequently, CMY values corresponding to a position of the L*·a*·b* coordinates in the normal printer table 26*a* are referred to (looked up) (Yes in S404). Moreover, since only discrete values are stored as positions of L*a*b* coordinates, in reality, CMY values corresponding to a closest position to the L*·a*·b* are referred to. In addition, the range of the normal printer table 26*a* and the range of the wide-color gamut printer table 26*b* are ranges determined in advance. In the present embodiment, the printer tables represent ranges determined in L*·a*·b* coordinates. FIG. 8 is a schematic diagram illustrating a printer table according to the first embodiment. For example, a printer table according to the present embodiment can be represented in three-dimensional space as shown in FIG. 8. In this case, when a cylindrical space shown in FIG. 8 is assumed to represent the normal printer table 26*a*, in the present embodiment, a transition is made to step S406 when the L*·a*·b* coordinates of at least one of the plurality of dots constituting an image is outside of the cylindrical space.

On the other hand, when the L*·a*·b* coordinates (which correspond to coordinates in the L*a*b* color system) are identified as being outside of the range of the normal printer table 26*a* (the range of the first color gamut), a determination is made on whether or not the L*·a*·b* coordinates are within the range of the wide-color gamut printer table 26*b*. When the L*·a*·b* coordinates are identified as being included in the range of the wide-color gamut printer table 26*b* (the range of the second color gamut), a transition is made to step S406 to refer to (look up) CMY values corresponding to a position of the L*·a*·b* coordinates in the wide-color gamut printer table 26*b*. Moreover, since only discrete values are stored as positions of L*·a*·b* coordinates, in reality, CMY values corresponding to a closest position to the L*·a*·b* are referred to.

In addition, after steps S405 and S406, transitions are respectively made to steps S407 and S412 and data of the CMY values is stored in a bitmap memory 42. When necessary, the CMY values may be corrected before being stored in the bitmap memory 42. For example, a difference between an actual L*·a*·b* value stored in these tables and desired calculated CMY values may be adjusted by an interpolating process. Generally, it is difficult to express a color corresponding to L*a*b* coordinates with CMY values. Therefore, the CMY values are corrected by the interpolating process so as to most closely approximate the color corresponding to a value of L*·a*·b* coordinates.

After steps S407 and S412, in steps S408 and S413, the printer driver 26 determines whether or not bitmap data for forming an image on the recording material P as a recording medium has been completed. In the present embodiment, as shown in FIG. 5, processing is performed for each of the plurality of dots constituting a digital image. In other words, processing is executed for each dot and bitmap data is stored in the bitmap memory 42 for each dot. Subsequently, when processing of all dots constituting the digital image is completed and bitmap data of all of the dots is stored in the bitmap memory 42, the bitmap data of the image is completed.

Therefore, when bitmap data is not completed in the bitmap memory 42, a return is made from step S408 to step S401 (from step S413 to step S414). On the other hand, when bitmap data is completed or when sufficient bitmap data is already stored in the bitmap memory 42, a transition is made to step S409 (step S417) (Yes in S409 (step S417)). Subsequently, gamma correction is performed in S409 (step S417). Specifically, gamma correction is performed with respect to the bitmap data stored in the bitmap memory 42 as the controller 600 executes a computer program. Accordingly, CMY values of the bitmap data in the bitmap memory 42 are adjusted so that brightness is uniformly distributed.

In step S410 (step S418), under-color removal is performed as the controller 600 executes a computer program and a black value of a dot (coordinates (x, y)) constituting the bitmap data is acquired. In the present embodiment, under-color removal is performed by a simple method of selecting a minimum value in CMY values and assigning the value to the black value. Specifically, for example, when C (cyan) has a value of 3, M (magenta) has a value of 4, and Y (yellow) has a value of 5, an image is formed using the K (black) toner in a portion of which the CMY values are 3. This is because K (black) is created by mixing C (cyan), M (magenta), and Y (yellow). Accordingly, toners of C (cyan), M (magenta), and Y (yellow) can be conserved. Moreover, for example, when C (cyan) has a value of 3, M (magenta) has a value of 0, and Y (yellow) has a value of 0, the K (black) toner is not used. It should be noted that, in the present embodiment, the order of S409 (step S417) and S410 (step S418) is not limited to that described above. For example, the order of S409 (step S417) and S410 (step S418) may be reversed in order to use specific color printing techniques such as continuous toning, dithering, and error diffusion.

Next, in steps S411 and S419, the controller 600 controls operations of the photosensitive drum 201, the developing roller 302, and the like to start color printing using the bitmap data indicated by the CMY values. In this case, when it is found in step S404 that the L*·a*·b* coordinates of at least one dot constituting the image is not within the range of the normal printer table 26*a* (the range of the first color gamut), printing is performed in step S419 in the wide-color gamut image formation mode. On the other hand, when it is found in step S404 that the L*·a*·b* coordinates of at least one dot constituting the image is within the range of the normal printer table 26*a*, printing is performed in step S411 in the normal image formation mode. Moreover, in the present embodiment, the same processing is performed in steps S401 and S414, in steps S402 and S415, in steps S403 and S416, and in steps S407 and S412. In a similar manner, the same processing is performed in steps S408 and S413, in steps S409 and S417, and in steps S410 and S418.

Figure 6:
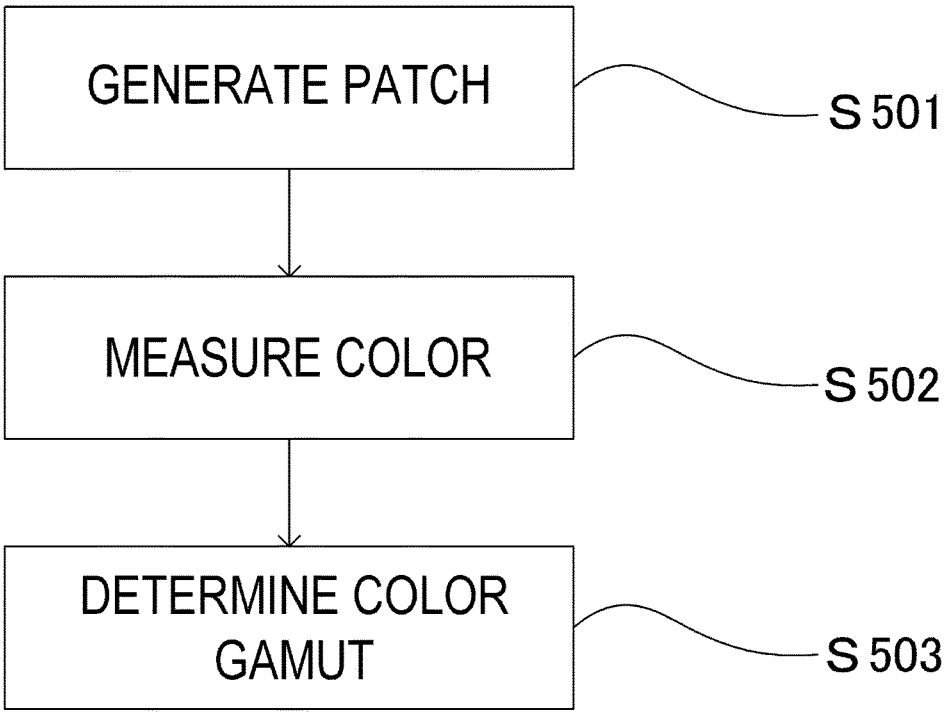
FIG. 6 is a flow chart showing a flow of generating a printer table according to the first embodiment.

FIG. 6 is a flow chart showing a flow of generating a printer table according to the first embodiment. Specifically, FIG. 6 is a flow chart for explaining a method of forming the normal printer table 26*a* and the wide-color gamut printer table 26*b*. The processing shown in FIG. 6 may be either performed only once for each image forming apparatus or performed when a need arises to readjust an image forming apparatus. Alternatively, the processing shown in FIG. 6 may be performed only once for image forming apparatuses with a same model number as a part of a factory process of adjusting the image forming apparatuses. In addition, the normal printer table 26*a* and the wide-color gamut printer table 26*b* are more favorably provided as software to the operator.

In FIG. 6, in step S501, a color gamut and a range of a color printable by the image forming apparatus 200 are measured. For example, with the image forming apparatus 200 used in the present embodiment, each of the CMY values is expressed as a numerical value from 0 to 64 (65 shades of gray). In addition, in the present embodiment, in order to measure a color gamut and a range of a color, a patch image is printed by the image forming apparatus 200 with respect to 17 C values (with numerical values of 0, 4, 8, 12, . . . , 64 (integer multiples of 4)), 17 M values, and 17 Y values. Furthermore, a color patch image is formed by combinations of the 17 CMY values. In other words, the image forming apparatus 200 is capable of expressing 17×17×17=4, 913 colors. Moreover, besides the chromatic colors formed by the method described above, a patch image of all expressible achromatic colors (in the present embodiment, 48 colors) is formed on the recording material P.

Next, in step S502, colors of 4,913 color patches and 48 achromatic color patches are measured in a device-independent color space such as the CIELAB color space described earlier. In addition, in step S503, each of 4,913+48=4,961 unique CMY color combinations is expressed in L*·a*·b coordinates (corresponding to coordinates in a L*a*b* color system). Accordingly, a color gamut and a range of colors printable by the image forming apparatus 200 can be measured. By respectively executing S501 to S503 in the normal image formation mode and the wide-color gamut image formation mode, the color gamut and the range of colors can be determined for each mode. The normal printer table 26*a* and the wide-color gamut printer table 26*b* are set based on color gamuts and ranges measured as described above.

The present embodiment adopts a configuration in which the normal printer table 26*a* is included in the wide-color gamut printer table 26*b*. Therefore, when a transform value of RGB values not accommodated in the normal printer table 26*a* is received, the controller performs control so that an image is formed using the wide-color gamut printer table 26*b*.

<Effect of First Embodiment>

In order to describe the effect of the first embodiment, first, an electrified charge amount of an electrostatic latent image formed on the photosensitive drum 201 as an image bearing member and an electrified charge amount of toner will be confirmed. In the present embodiment, in the photosensitive drum 201, a dark-part potential which refers to a potential of a portion not exposed by a laser is set to −500 [V] and a light-part potential which refers to a potential of a portion exposed by the laser is set to −100 [V]. In addition, in the present embodiment, the light-part potential is acquired by measuring a surface of the photosensitive drum 201 with a potentiometer when forming an image pattern (for example, a solid black image) which causes an image to be formed over the entire recording material P. Furthermore, by setting a developing potential of the developing roller to −300 [V], a difference between the light-part potential of the photosensitive drum 201 and the potential of the developing roller 302 and a difference between the dark-part potential of the photosensitive drum 201 and the potential of the developing roller 302 are respectively set to Δ200 [V]. Herein, the difference between the light-part potential of the photosensitive drum 201 and the potential of the developing roller 302 and the difference between the dark-part potential of the photosensitive drum 201 and the potential of the developing roller 302 will be referred to as a development contrast.

In addition, with respect to toner to adhere to the developing roller 302 as a developer bearing member, in the present embodiment, a toner amount per unit area (hereafter, denoted by M/S) is set to $3.0\times10^{-3}$ [kg/m$^2$]. Furthermore an electrified charge amount of the toner per unit area (hereafter, denoted by Q/S) is set to $-0.15\times10^{-3}$ [C/m$^2$]. Subsequently, the toner supply amount with respect to the development contrast was confirmed. In the present embodiment, the toner supply amount was confirmed by setting a peripheral velocity of the photosensitive drum 201 as an image bearing member to 0.2 [m/s] (constant) and varying a peripheral velocity of the developing roller 302 relative to the photosensitive drum 201. Moreover, a peripheral velocity ratio of 100% is assumed to represent a case where the peripheral velocities of the photosensitive drum 201 and the developing roller 302 are the same and a peripheral velocity ratio of 140% is assumed to represent a case where the peripheral velocity of the developing roller 302 is 1.4 times the peripheral velocity of the photosensitive drum 201. In addition, since a tinge of an image and density of the image are strongly related to each other, the present embodiment will be described with a focus on image density. Furthermore, YMC toners were used in an experiment for confirming the effect of the first embodiment.

Figure 7:
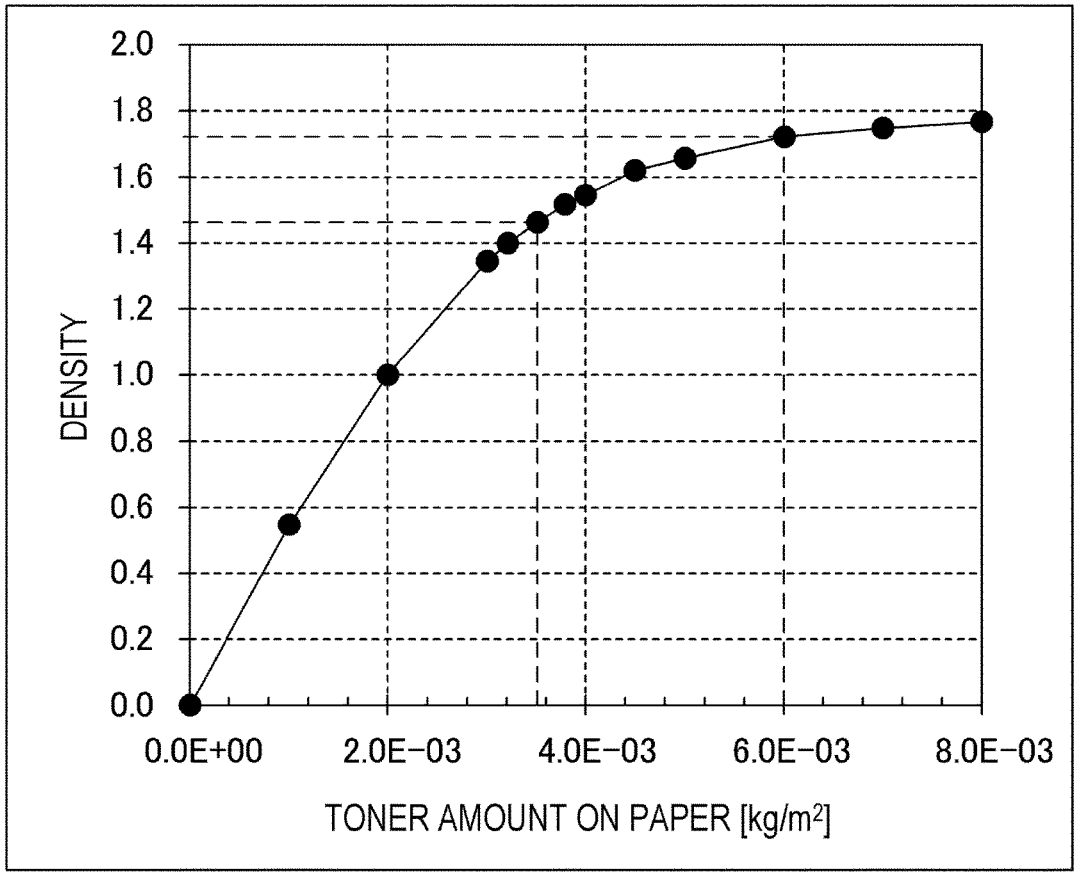
FIG. 7 is a diagram showing a relationship between an amount of toner forming an image and density of the image according to the first embodiment.

A toner image formed on the photosensitive drum 201 is eventually fixed onto the recording material Pas a recording medium. FIG. 7 is a diagram showing a relationship between an amount of toner forming an image and density of the image according to the first embodiment. Moreover, since there is no difference among experiment results of the YMC toners, the experiment result will be described using the cyan toner. In the case of a peripheral velocity ratio of 120%, density of 1.45 (Macbeth RD-918) generally required in office documents was obtained and a toner laid-on level on the recording material P was $3.6\times10^{-3}$ kg/m$^2$. When the peripheral velocity ratio was increased to 200%, density of 1.72 was obtained and the toner laid-on level on the recording material P was $6.0\times10^{-3}$ kg/m$^2$. Moreover, in the present embodiment, the peripheral velocity ratio between the photosensitive drum 201 and the developing roller 302 is set to 120% in the normal image formation mode and the peripheral velocity ratio between the photosensitive drum 201 and the developing roller 302 is set to 200% in the wide-color gamut image formation mode. However, peripheral velocity ratios are not necessarily limited to the above. The peripheral velocity ratio between the photosensitive drum 201 and the developing roller 302 is changed as appropriate depending on a configuration of the image forming apparatus 200. For example, the peripheral velocity ratio between the photosensitive drum 201 and the developing roller 302 may be changed when the toner used by the image forming apparatus 200 is changed.

In consideration thereof, the peripheral velocity ratio is set to 120% in the normal image formation mode as a normal mode intended for office applications and the like so that image density of 1.45 is attained. In addition, in the present embodiment, the peripheral velocity ratio is set to 200% in the wide-color gamut image formation mode as a color gamut enlargement mode so that image density of 1.7 or higher is attained. As a result, when changing the peripheral velocity ratio from 120% to 200%, a ΔE target enlargement amount of 10 or larger was secured for red. In this case, "a ΔE target enlargement amount of 10 or larger" means that a value of L*·a*·b* coordinates increased by 10 or more. Moreover, red is created by mixing the Y and M toners at a ratio of 1:1.

The colors were measured using i1pro manufactured by X-Rite, Incorporated. Measurements were conducted under conditions of a black backing, a D50 light source, and a 2-degree visual field. In addition, GF-C081 manufactured by Canon Inc. was used as paper for sampling. Furthermore, the fixing apparatus 400 was configured to convey the recording material P to a nip portion of the film 430 and the pressure roller 440 after a lapse of 10 seconds from the moment a temperature of an outlet of the nip portion of the film 430 and the pressure roller 440 reached 180° C.

In addition, for each of the normal image formation mode and the wide-color gamut image formation mode, an image was formed on the recording material P in a high temperature, high humidity environment (30° C., 80%) using A4 paper under the following conditions.

(1) COMPARATIVE EXAMPLE 1

After consecutively printing an image (print percentage: around 5%) containing both characters and graphic on entire surfaces of 100 sheets of the recording material P, a full-page solid image of a color not reproducible in the normal image formation mode is consecutively printed on 100 sheets. In other words, a total of 200 sheets of images are printed. In this case, high-density images are constantly formed in the wide-color gamut image formation mode without automatically switching between the normal image formation mode and the wide-color gamut image formation mode.

(2) Present Embodiment

After consecutively printing an image (print percentage: around 5%) containing both characters and graphic on entire surfaces of 100 sheets of the recording material P, a full-page solid image of a color not reproducible in the normal image formation mode is consecutively printed on 100 sheets. In other words, a total of 200 sheets of images are printed. In this case, in the present embodiment, the normal image formation mode and the wide-color gamut image formation mode are automatically switched. In the present embodiment, as described above, "a color not reproducible in the normal image formation mode" refers to a color of which, when RGB values are transformed into CMY values, any of CMY exceeds 100%.

In the comparative example and the embodiment, color gamuts were respectively confirmed by sampling solid images after the number of printed sheets exceeded 100. Experiment results are shown in Table 1. As shown in Table 1, in the embodiment, image density was maintained even when consecutively forming images on 200 sheets. In addition, in the embodiment, the ΔE target enlargement amount was 10 or larger and colors not reproducible in the normal image formation mode became reproducible. In contrast, in the comparative example, image density non-uniformity was confirmed in a rear end portion of images formed on the recording material P before the number of printed sheets reached 100. A level of image density non-uniformity was not a level of blank dots at which the image completely disappears but, rather, non-uniformity in image density was created over the entire image. In the comparative example, an increase in a peripheral velocity difference between the photosensitive drum 201 as an image bearing member and the developing roller 302 as a developer bearing member caused the toners to slide against each other and resulted in toner degradation. Accordingly, image density non-uniformity was created in the rear end portion of images formed on the recording material P as a recording medium. In addition, in the comparative example, the target enlargement amount of ΔE was not 10 or larger and a color gamut of images to be formed on the recording material P could not be enlarged. Specifically, since images contained image density non-uniformity in the comparative example, the target enlargement amount of ΔE did not reach the target value in portions with low image density. Furthermore, in a similar manner, in the comparative example, since images contained image density non-uniformity, colors not reproducible in the normal image formation mode remained nonreproducible.

TABLE 1

| | 100TH SHEET | 200TH SHEET |
|---|---|---|
| PRESENT EMBODIMENT | ○ COLOR REPRODUCIBLE | ○ COLOR REPRODUCIBLE |
| COMPARATIVE EXAMPLE | X COLOR NONREPRODUCIBLE | X COLOR NONREPRODUCIBLE |

As described above, in the present embodiment, based on image information, when a color gamut of an image to be formed on a recording material P is a color gamut in which an image can be formed in a normal image formation mode, the image is formed in the normal image formation mode. On the other hand, based on image information, when a color gamut of an image to be formed on the recording material P is not a color gamut in which an image can be formed in the normal image formation mode, the image is formed in a wide-color gamut image formation mode. Accordingly, deterioration of toners can be suppressed and a color gamut of an image to be formed on the recording material P can be enlarged without having a user himself/herself perform settings. In other words, a preferable image can be formed while suppressing a decline in usability and toner deterioration.

(Second Embodiment)

In the present embodiment, unlike in the first embodiment, the peripheral velocity of the developing roller 302 as a developer bearing member is set to a constant velocity (0.2 m/s). In addition, in the wide-color gamut image formation mode, the peripheral velocity ratio between the developing roller 302 as a developer bearing member and the photosensitive drum 201 as an image bearing member is changed by reducing the peripheral velocity of the photosensitive drum 201. Furthermore, together with reducing the peripheral velocity of the photosensitive drum 201, the peripheral velocities of the film 430 and the pressure roller 440 are reduced in the fixing apparatus 400. Accordingly, since a period of time over which the recording material P is heated by the fixing apparatus 400 increases, even when an amount of toner forming an image in the wide-color gamut image formation mode is increased, a toner image is fixed to the recording material P in a stable manner.

In this case, in the image forming apparatus 200, a velocity of a surface of the intermediate transfer belt 205 corresponds to the peripheral velocity of the photosensitive drum 201. In addition, since the recording material P is sandwiched and conveyed to the fixing apparatus 400 by a nip portion of the intermediate transfer belt 205 and the secondary transfer roller 213, the velocity of the surface of the intermediate transfer belt 205 corresponds to a speed of the recording material P being conveyed to the fixing apparatus 400. Therefore, hypothetically, when only the peripheral velocities of the film 430 and the pressure roller 440 are reduced without reducing the peripheral velocity of the photosensitive drum 201, the recording material P ends up entering the fixing apparatus 400 at a higher velocity than the peripheral velocities of the film 430 and the pressure roller 440. In this case, there is a risk that a toner image may not be fixed to the recording material P in a preferable manner. However, in the present embodiment, by reducing the peripheral velocity of the photosensitive drum 201, the peripheral velocities of the film 430 and the pressure roller 440 can also be reduced. Accordingly, since a period of time over which the recording material P is heated by the fixing apparatus 400 increases, a toner image can be fixed to the recording material P in a stable manner. In addition, in the present embodiment, since smoothness of melted toner can be improved, diffusely-reflected light on a surface of an image formed on the recording material P is reduced and chroma of the image is improved.

<Effect of Second Embodiment>

In the present embodiment, in the wide-color gamut image formation mode as a color gamut enlargement mode, the peripheral velocity of the developing roller 302 is set to a constant velocity (0.2 [m/s]) and the peripheral velocity of the photosensitive drum 201 is set to 0.1 [m/s] (a 50% peripheral velocity of the developing roller 302) at minimum. Accordingly, the peripheral velocity ratio between the photosensitive drum 201 and the developing roller 302 is varied to enlarge a color gamut of an image to be formed on the recording material P. In this case, since a tinge and density of the image to be formed on the recording material P are strongly related to each other, an effect of the present embodiment will be described with a focus on image density. Moreover, YMC toners were used to form images on the recording material P in an experiment for confirming the effect of the second embodiment.

As described earlier, a toner image formed on the photosensitive drum 201 as an image bearing member is eventually fixed onto the recording material P. In the present embodiment, a relationship between an amount of toner fixed to the recording material P and image density was similar to that in the first embodiment. In this case, since there was no difference among experiment results of the YMC toners, the experiment result of the cyan toner will be described. In the case of a peripheral velocity ratio of 120%, density of 1.45 (Macbeth RD-918) generally required in office documents was obtained and a toner laid-on level on the recording material P was $3.6\times10^{-3}$ kg/m$^2$. When the peripheral velocity ratio was increased to 200%, density of 1.72 was obtained and the toner laid-on level on the recording material P was $6.0\times10^{-3}$ kg/m$^2$.

In consideration thereof, the peripheral velocity ratio was set to 120% in the normal image formation mode intended for office applications and the like so that an image density of 1.45 is attained. In addition, in the present embodiment, the peripheral velocity ratio was set to 200% in the wide-color gamut image formation mode so that an image density of 1.7 or higher is attained. As a result, when changing the peripheral velocity ratio from 120% to 200%, a ΔE target enlargement amount of 15 or larger was secured for red. In this case, "a ΔE target enlargement amount of 15 or larger" means that a value of L*·a*·b* coordinates increased by 15 or more. Moreover, red is created by mixing the Y and M toners at a ratio of 1:1. As described earlier, in the present embodiment, since the period of time over which the recording material P is heated by the fixing apparatus 400 increases, a toner image can be fixed to the recording material P in a stable manner. Therefore, gloss of the image fixed to the recording material P increased (a value in the L* direction in L*·a*·b* coordinates increased) and resulted in a ΔE target enlargement amount of 15 or larger.

The colors were measured using i1pro manufactured by X-Rite, Incorporated. Measurements were conducted under conditions of a black backing, a D50 light source, and a 2-degree visual field. In addition, Image Coat Gloss 158 manufactured by Canon Inc. was used as paper for sampling. Furthermore, the fixing apparatus 400 was configured to convey the recording material P to the nip portion of the film 430 and the pressure roller 440 after a lapse of 10 seconds from the moment a temperature of an outlet of the nip portion of the film 430 and the pressure roller 440 reached 180° C.

In addition, for each of the normal image formation mode and the wide-color gamut image formation mode, an image was formed on the recording material P in a high temperature, high humidity environment (30° C., 80%) using sheets of Image Coat Gloss 158 manufactured by Canon Inc. under the following conditions.

(1) COMPARATIVE EXAMPLE 2

After consecutively printing an image (print percentage: around 5%) containing both characters and graphic on entire surfaces of 100 sheets of the recording material P, a full-page solid image of a color not reproducible in the normal image formation mode is consecutively printed on 100 sheets. In other words, a total of 200 sheets of images are printed. In this case, high-density images are constantly formed in the wide-color gamut image formation mode without automatically switching between the normal image formation mode and the wide-color gamut image formation mode.

(2) Present Embodiment

After consecutively printing an image (print percentage: around 5%) containing both characters and graphic on entire surfaces of 100 sheets of the recording material P, a full-page solid image of a color not reproducible in the normal image formation mode is consecutively printed on 100 sheets. In other words, a total of 200 sheets of images are printed. In this case, in the present embodiment, the normal image formation mode and the wide-color gamut image formation mode are automatically switched.

In the comparative example and the present embodiment, color gamuts were respectively confirmed by sampling solid images after the number of printed sheets exceeded 100. Experiment results are shown in Table 2. As shown in Table 2, in the embodiment, image density was maintained even when consecutively forming images on 200 sheets. In addition, in the embodiment, the ΔE target enlargement amount was 15 or larger and colors not reproducible in the normal image formation mode became reproducible. In contrast, in the comparative example, image density non-uniformity was confirmed in a rear end portion of images formed on the recording material P before the number of printed sheets reached 100. A level of image density non-uniformity was not a level of blank dots at which the image completely disappears but, rather, non-uniformity in image density was created over the entire image. In addition, in the comparative example, the target enlargement amount of ΔE was not 15 or larger and a color gamut of images to be formed on the recording material P could not be enlarged.

TABLE 2

| | 100TH SHEET | 200TH SHEET |
|---|---|---|
| PRESENT EMBODIMENT | ○ COLOR REPRODUCIBLE | ○ COLOR REPRODUCIBLE |
| COMPARATIVE EXAMPLE | X COLOR NONREPRODUCIBLE | X COLOR NONREPRODUCIBLE |

As described above, in the present embodiment, based on image information, when a color gamut of an image to be formed on a recording material P is a color gamut in which an image can be formed in a normal image formation mode as a normal mode, the image is formed in the normal image formation mode. On the other hand, based on image information, when a color gamut of an image to be formed on the recording material P is not a color gamut in which an image can be formed in the normal image formation mode, the image is formed in a wide-color gamut image formation mode. Accordingly, deterioration of toners can be suppressed and a color gamut of an image to be formed on the recording material P can be enlarged without having a user himself/herself perform settings. In other words, a preferable image can be formed while suppressing a decline in usability and toner deterioration.

In addition, in the present embodiment, the peripheral velocity of the developing roller 302 as a developer bearing member is set higher than the peripheral velocity of the photosensitive drum 201 as an image bearing member by reducing the peripheral velocity of the photosensitive drum 201. Accordingly, since the peripheral velocity of the pressure roller 440 in the fixing apparatus 400 can be reduced, the period of time over which the recording material P is heated by the fixing apparatus 400 increases. As a result, a toner image is fixed to the recording material P in a stable manner even when an amount of toner forming an image in the wide-color gamut image formation mode increases.

Moreover, while the normal image formation mode and the wide-color gamut image formation mode are automatically switched in the respective embodiments, this configuration is not necessarily restrictive. For example, a mode in which the normal image formation mode and the wide-color gamut image formation mode are automatically switched may be combined with a mode in which the user himself/herself selects either the normal image formation mode or the wide-color gamut image formation mode. Specifically, specifications may be adopted in which, when the user has selected the normal image formation mode, the wide-color gamut image formation mode is not executed. Alternatively, specifications may be adopted in which the wide-color gamut image formation mode is not executed unless the wide-color gamut image formation mode is selected.

Moreover, while steps S401 to S407, S412, and S414 to S416 in the flow chart shown in FIG. 5 are executed by the host CPU 20 in the respective embodiments, this configuration is not necessarily restrictive. For example, the host CPU 20 may be provided in the image forming apparatus 200 and the image forming apparatus 200 may execute steps S401 to S419.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-057719, filed on Mar. 22, 2016, which is hereby incorporated by reference herein in its entirety.

What is claimed is:

1. An image forming apparatus, for forming an image on a recording medium based on image data, comprising:

an image bearing member on which an electrostatic image is formed;

a developer bearing member configured to bear a developer for developing the electrostatic image formed on the image bearing member; and a controller configured to be capable of executing a normal mode in which the electrostatic image formed on the image bearing member is developed by setting a peripheral velocity ratio of the developer bearing member to the image bearing member to a prescribed peripheral velocity ratio, and a color gamut enlargement mode in which a color gamut of an image to be formed on the recording medium is enlarged as compared to the normal mode by setting the peripheral velocity ratio of the developer bearing member to the image bearing member to a higher peripheral velocity ratio than the peripheral velocity ratio in the normal mode, wherein the controller is configured to identify whether or not image color gamut information included in the image data is within a range for the normal mode, and execute the normal mode for forming an image in a case where the image color gamut information is within the range, and execute the color gamut enlargement mode in a case where the image color gamut information is outside of the range.

2. The image forming apparatus according to claim 1, wherein the controller is configured to:

form an image in the normal mode when a color gamut in the image color gamut information included in the image data is within a range of a first color gamut, and form an image in the color gamut enlargement mode when the color gamut in the image color gamut information included in the image data is beyond the range of the first color gamut and within a range of a second color gamut which is larger than the first color gamut.

3. The image forming apparatus according to claim 2, wherein the image data is formed by a plurality of dots, and when a color of at least one of the plurality of dots is not included in the first color gamut, the image forming apparatus is controlled to execute the color gamut enlargement mode.

4. The image forming apparatus according to claim 1, wherein the image bearing member is a photosensitive drum, the developer bearing member is a developing roller, and in the color gamut enlargement mode, a color gamut of an image to be formed on the recording medium is enlarged as compared to the normal mode by setting a peripheral velocity of the developer bearing member to a higher peripheral velocity than a peripheral velocity of the image bearing member.

5. The image forming apparatus according to claim 1, wherein the image data is expressed by values of red, green, and blue.

6. The image forming apparatus according to claim 5, wherein the image data expressed by the values of red, green, and blue is transformed into coordinates in a L*a*b* color system.

7. The image forming apparatus according to claim 6, wherein in the image data expressed by the coordinates in the L*a*b* color system, an L coordinate representing brightness of an image is transformed into a value which enables an image to be formed by the image forming apparatus.

8. The image forming apparatus according to claim 7, wherein when the image data expressed by the coordinates in the L*a*b* color system is within prescribed coordinates in the L*a*b* color system, a color gamut in the image color gamut information included in the image data is determined to be within a range of a first color gamut and an image is formed in the normal mode, and when the image data expressed by the coordinates in the L*a*b* color system is not within the prescribed coordinates in the L*a*b* color system, the color gamut in the image color gamut information included in the image data is determined to be within a range of a second color gamut and an image is formed in the color gamut enlargement mode.

9. The image forming apparatus according to claim 8, wherein the image data expressed by the coordinates in the L*a*b* color system is transformed into values of yellow, magenta, and cyan.

10. The image forming apparatus according to claim 9, wherein a color of the image data transformed into values of yellow, magenta, and cyan is corrected so as to most closely approximate a color corresponding to a value of L*a*b* coordinates.

11. The image forming apparatus according to claim 10, wherein for a portion which becomes black by mixing yellow, magenta, and cyan among colors expressed by yellow, magenta, and cyan, an image is formed using a black developer.

12. An image forming apparatus, for forming an image on a recording medium based on image data, comprising:

an image bearing member on which an electrostatic image is formed;

a developer bearing member configured to bear a developer for developing the electrostatic image formed on the image bearing member; and a controller configured to be capable of executing a normal mode in which the electrostatic image formed on the image bearing member is developed by setting a peripheral velocity ratio of the developer bearing member to the image bearing member to a prescribed peripheral velocity ratio, and a color gamut enlargement mode in which a color gamut of an image to be formed on the recording medium is enlarged as compared to the normal mode by setting the peripheral velocity ratio of the developer bearing member to the image bearing member to a higher peripheral velocity ratio than the peripheral velocity ratio in the normal mode, wherein the controller is configured to identify image color gamut information included in the image data, and form an image by selecting the normal mode or the color gamut enlargement mode in accordance with the image color gamut information, wherein in the color gamut enlargement mode, a color gamut of an image to be formed on the recording medium is enlarged as compared to the normal mode by setting a peripheral velocity of the developer bearing member to a higher peripheral velocity than a peripheral velocity of the image bearing member, and wherein in the color gamut enlargement mode, the peripheral velocity of the developer bearing member is set to a higher peripheral velocity than the peripheral velocity of the image bearing member by reducing the peripheral velocity of the image bearing member.

* * * * *